US007151992B2

(12) United States Patent
Dort

(10) Patent No.: US 7,151,992 B2
(45) **Date of Patent: *Dec. 19, 2006**

(54) EXTERNALLY ACTIVATED NON-NEGATIVE ACCELERATION SYSTEM

(75) Inventor: David Bogart Dort, Washington, DC (US)

(73) Assignee: VRBIA, Inc., Arlington, VA (US)

( * ) Notice: Subject to any disclaimer, the term of this patent is extended or adjusted under 35 U.S.C. 154(b) by 151 days.

This patent is subject to a terminal disclaimer.

(21) Appl. No.: 10/803,472

(22) Filed: Mar. 17, 2004

(65) Prior Publication Data

US 2005/0165537 A1 Jul. 28, 2005

Related U.S. Application Data

(63) Continuation-in-part of application No. 10/786,177, filed on Feb. 23, 2004, now Pat. No. 7,092,815, which is a continuation-in-part of application No. 10/772,776, filed on Feb. 5, 2004, now abandoned.

(51) Int. Cl.
*G08G 1/08* (2006.01)
*G08G 1/09* (2006.01)

(52) U.S. Cl. ..... 701/70; 701/96; 340/905

(58) Field of Classification Search ..... 701/117, 701/213, 96, 301, 115, 35; 340/995.13, 905, 340/933, 919, 928, 935, 941, 903; 180/169, 180/170, 178, 287
See application file for complete search history.

(56) References Cited

U.S. PATENT DOCUMENTS 3,188,927 A * 6/1965 Woods ..... 404/9
3,544,959 A * 12/1970 Hawks ..... 340/932
3,750,099 A * 7/1973 Proctor ..... 340/932
3,790,780 A * 2/1974 Helmcke et al. ..... 246/187 C
3,872,423 A * 3/1975 Yeakley ..... 340/932
5,134,393 A 7/1992 Henson

OTHER PUBLICATIONS (*Acceleration*) Using RF(*ID*) by NERAC, Jay Zocco, Investigator, Feb. 19, 2004. (400 pages).
(*Acceleration*) Using RF(*ID*) by NERAC, Jay Zocco, Investigator, Feb. 23, 2004. (20 pages).

* cited by examiner

*Primary Examiner*—Dalena Tran
(74) *Attorney, Agent, or Firm*—Rubinstein Law Group P.C.

(57) ABSTRACT

The present invention is designed to complement the existing transportation infrastructure in order to alleviate ever-worsening traffic congestion in problematic areas by minimizing the impact of driver "bunching" habits and/or external events that lead to congestion problems. Events alleviated by the present invention may happen at naturally occurring roadway infrastructures such as merges, lane shifts, and exits, and under conditions like rush hour, accidents, stand-stills, and HOV lane activation times. Further, vehicles allowing their speed and spacing to be controlled should have access to high-flow lanes. This invention will best and most safely be implemented at low speeds when congestion is most problematic and bunching habits prevent the dissipation of gridlock. In particular embodiments, the invention will regulate multiple vehicle accelerations (non-negative acceleration) once a low threshold speed has been reached through the transmission of signals to receivers in properly equipped vehicles. The exclusive non-negative acceleration control system simplifies the manufacturing, safety and redundancy necessary for implementing such a system and is commercially viable.

8 Claims, 16 Drawing Sheets

EXTERNALLY ACTIVATED NON-NEGATIVE ACCELERATION SYSTEM

REFERENCE TO PRIORITY DOCUMENTS

This patent application is a continuation-in-part and claims priority under 35 USC §120 to U.S. application Ser. No. 10/786,177, filed Feb. 23, 2004, now U.S. Pat. No. 7,092,815 which is a continuation-in-part that claims priority under 35 USC §120 to U.S. application Ser. No. 10/772,776, filed Feb. 5, 2004, now abandoned which are both incorporated herein by reference for all purposes.

BACKGROUND

It is well-known in traffic flow mathematics that the closer vehicles are spaced together the slower the flow, and this is shown by the general traffic flow principle expressed by the equation:

where r(n,m) is the distance between two vehicles, n and m, and dn/dt and dm/dt represent the velocity of the two vehicles:

as $r(n,m) \rightarrow 0$, $dn/dt \rightarrow 0$ and $dm/dt \rightarrow 0$ as well.

The main problem in getting a congestive traffic event flowing again is actually the behavior of the drivers themselves. FIGS. 1A–1C show the behavioral characteristics of drivers that cause continued gridlock problems. The main problem is that drivers fail to space themselves apart from a vehicle in front of them (or, in a merge situation, a two-dimensional spacing) when the traffic flow resumes, thus keeping r(n,m) close to 0 at all times. Even if a driver is attempting to space themselves from the leading vehicle, an erratic "dissipation speed" may bunch the two cars again keeping traffic from flowing. FIG. 1A shows a representative traffic event at time T(E) or time of event, the location of the event is shown by a star and labeled P(tc) where the velocity of the representative four vehicles is near zero (v vector=0). FIG. 1B depicts the initial dissipation of the traffic congestion event in FIG. 1A and a chosen t(0) or initial time. In FIG. 1B the distance r(n,m) initially may increase, but as shown in FIG. 1C at time t(0)+i (where i=2 seconds in the illustrative example), r(n,m) is decreased through driver behavior (acceleration (a(n)), not letting a vehicle merge properly, etc.) or other circumstances to decrease distance and leading back to congestion as shown by the bunching in vehicles 3 and 4 and the closing gap between n and m.

FIG. 2 also depicts another type of congestion based on driver habits in a highway merge zone which causes unnecessary slowing and congestion problems. The merges tend to complicated traffic flow both in the merge lanes and the travel lane into which the merge lane flow and the adjacent lanes. In this diagram, velocity x is a threshold velocity which indicates that the travel lane traffic has dropped below a target velocity most likely due to the problems created by the merge lane traffic. The velocity of the vehicle in the lane adjacent to the travel lane while at a threshold will also likely drop below the threshold if vehicles in the travel lane continue to pull into the adjacent lane from low or stopped velocity.

A way to keep efficient spacing during the dissipation of a traffic congestion event would facilitate traffic flow and reduce the problems caused by driver impatience and other natural occurring traffic events such as merges.

SUMMARY OF THE INVENTION

The present invention is designed to complement the existing transportation infrastructure in order to alleviate ever-worsening traffic congestion in problematic areas by minimizing the impact of driver "bunching" habits and/or external events that lead to congestion problems. Events alleviated by the present invention may happen at naturally occurring roadway infrastructures such as merges, lane shifts, and exits, and under conditions like rush hour, accidents, stand-stills, and HOV lane activation times. Further, vehicles allowing their speed and spacing to be controlled should have access to high-flow lanes. This invention will best and most safely be implemented at low speeds when congestion is most problematic and bunching habits prevent the dissipation of gridlock. In particular embodiments, the invention will regulate multiple vehicle accelerations (non-negative acceleration) once a low threshold speed has been reached through the transmission of signals to receivers in properly equipped vehicles. The transmitters are connected to a computational network that allow for increased spacing over a zone or a plurality of zones. In the preferred embodiment, only non-negative acceleration is governed keeping the safety features of the non-negative acceleration governor to a minimum.

BRIEF DESCRIPTION OF THE DRAWINGS

The invention can be better understood by reference to the following illustrative drawings, in which.

DETAILED DESCRIPTION

Various aspects of vehicular control, RF transmission, and traffic control are taught in specific patents which are incorporated herein by reference. These include U.S. Pat. Nos. 4,449,114, 4,403,208, 4,356,489 for RF aspects of vehicle sensing. Other background technology incorporated herein for teaches various aspects of the components of the invention include: U.S. Pat. No. 6,356,833 to Joen teaches a the RF control of a vehicle in a particular driving state. See Also. WIPO Pat. Publication 2000-11629 to Olsson teaches reducing traffic through route control (See also U.S. Pat. No. 6,427,114). WIPO Pat. Publication 1998-35276 to Douglas teaches a navigating system using RF transmission to vehicles in a workplace. U.S. Pat. No. 5,289,183 to Hassett et. al. teaches a plurality of read write transponders in roadway sensors that collect information about specific vehicles.

The following references provide other background to the present invention: U.S. Pat. Pubs. 2003-0004633 and 2002-0072843 to Russell et. al. from U.S. application Ser. Nos. 10/217,128 and 09/931,630 teaches a system for adjusting cruise control so that a safe distance is kept between vehicles. U.S. Pat. Pub. 2002-67660 to Bokhour from U.S. application Ser. No. 09/977,858 teaches collision avoidance system based on RF. U.S. Pat. Pubs. 2002-32515 and 2002-16663 to Nakamara from U.S. application Ser. Nos. 09/986,364 and 944201 teaches a collision avoidance system by measuring the distance from the preceding vehicle. U.S. Pat. No. 6,155,558 to Testa teaches a speed limit transmission device. U.S. Pat. Nos. 5,803,043 and 5,796,051 to Bayron et al teaches an input system for a power and speed controller. U.S. Pat. No. 5,526,357 to Jandrell teaches a system for locating a transponder unit. Speed limit control inventions are taught in U.S. Pat. No. 6,285,943 to Boulter, U.S. Pat. No. 6,163,277 to Gehlot, and U.S. Pat. No. 6,134,499 to Goode et. al, and U.S. Pat. No. 6,016,458 to Robinson et al. all incorporated by reference. These inventions may have particular aspects that may be useful in considered the structure and operation of the presently claimed invention, but are not contemplated in the solution of regional traffic problems caused by bunching, merges or other traffic congestion phenomena.

Figure 1A:
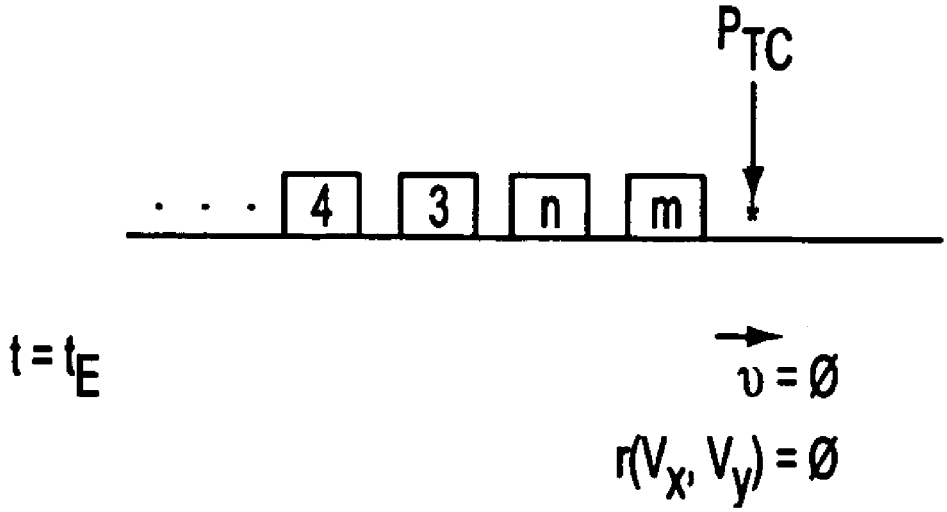
FIGS. 1A–C show a traffic flow congestion event in three respective time sequences.
Figure 1B:
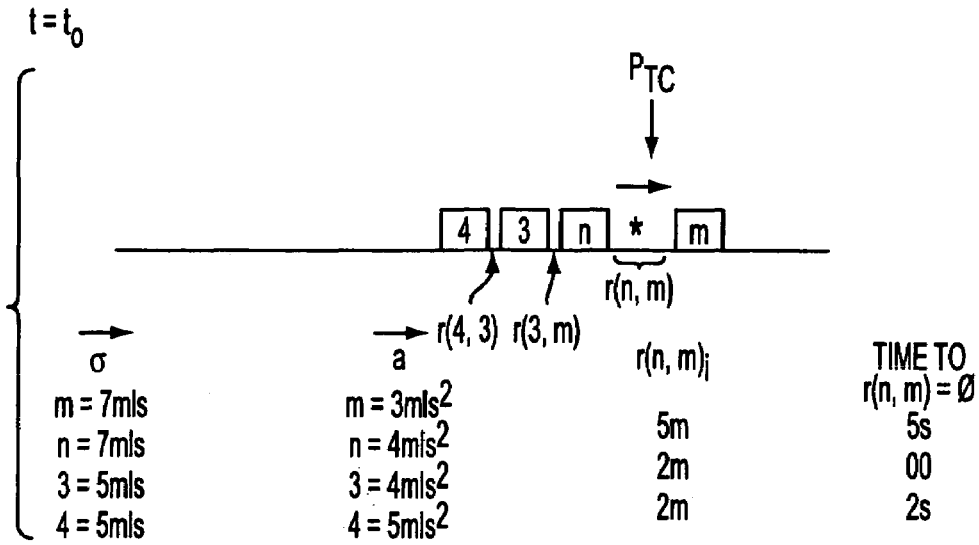
Figure 1C:
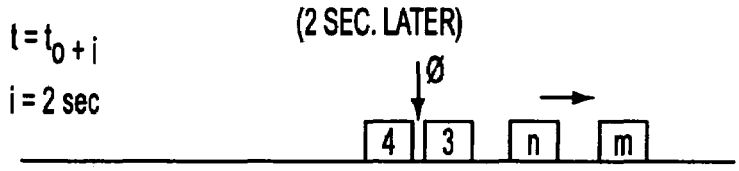
Figure 2:
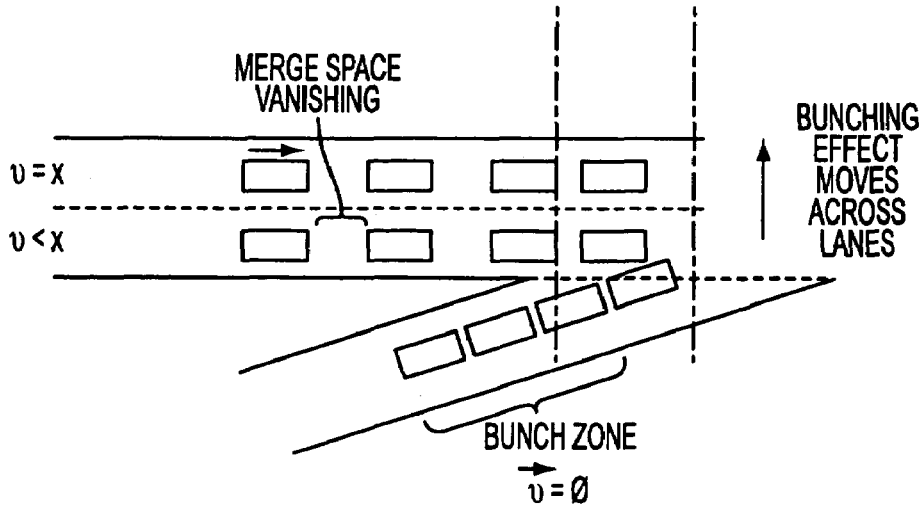
FIG. 2 shows a traffic congestion event based on merged traffic.
Figure 3A:
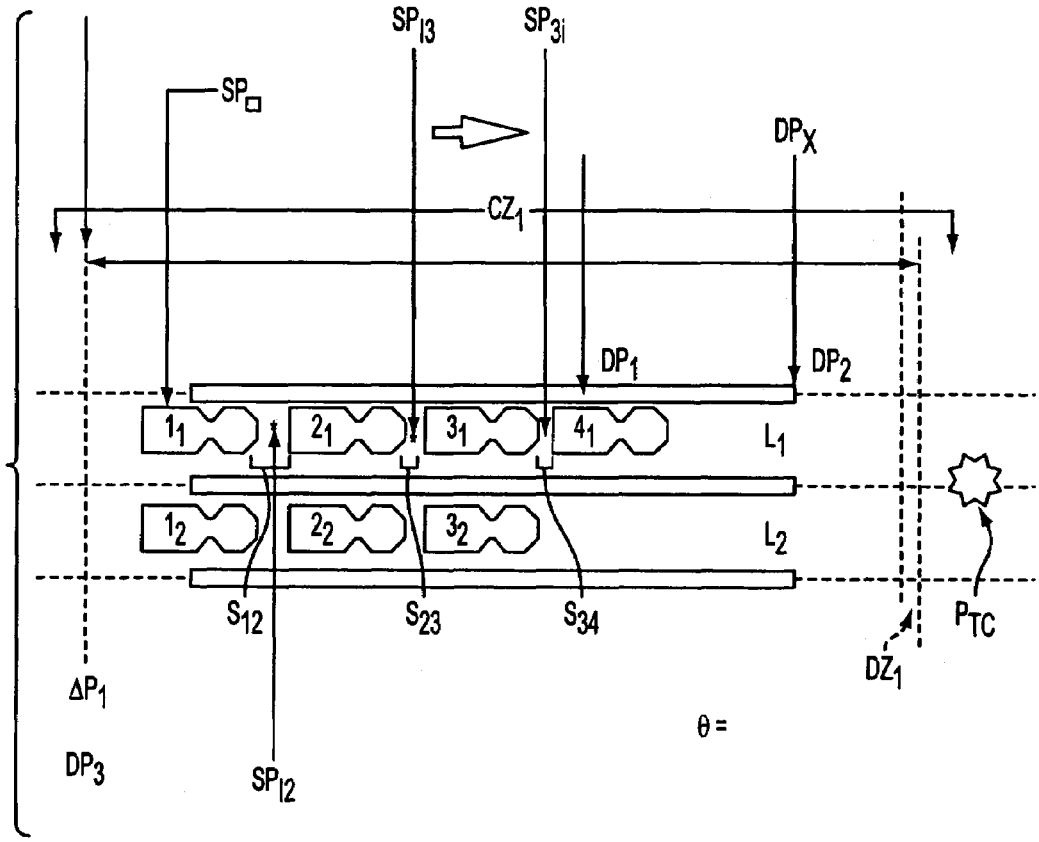
FIG. 3A is the traffic flow control system before activation.

A traffic flow event, such as stopped vehicles is detected to motion detectors at detection points in the speed control area or congestion control zone is shown in FIGS. 1A–C or merge zone in FIG. 2. Referring now to FIG. 3A, a functional diagram of the invention is shown. The stopped or slowed vehicle(s) in lane 1, L1 shown as V1(1), V2(1), V3(1), V4(1) activates the spacing system at the activation zone, AZ, or activation points, AP(x), AP(1) that activate and allows spacers S(rearnum, frontnum), shown as S(1-2), S(2-3), S(3-4) to prevent vehicles from bunching up by operating in the "stop and go" mode. The spacers can be physical devices such as Kevlar flags attached to a moving conveyor (with appropriate springs or other mechanical protection in the mechanical movement area or layer (not shown)) or electronic such as lights or diodes, but in a preferred embodiment are transmitter-receiver systems which control the speed of the vehicle, through controlling the acceleration of the vehicle after an event is detected at detection points, DP(1), DP(2) or detection zones DZ(1).

Figure 3B:
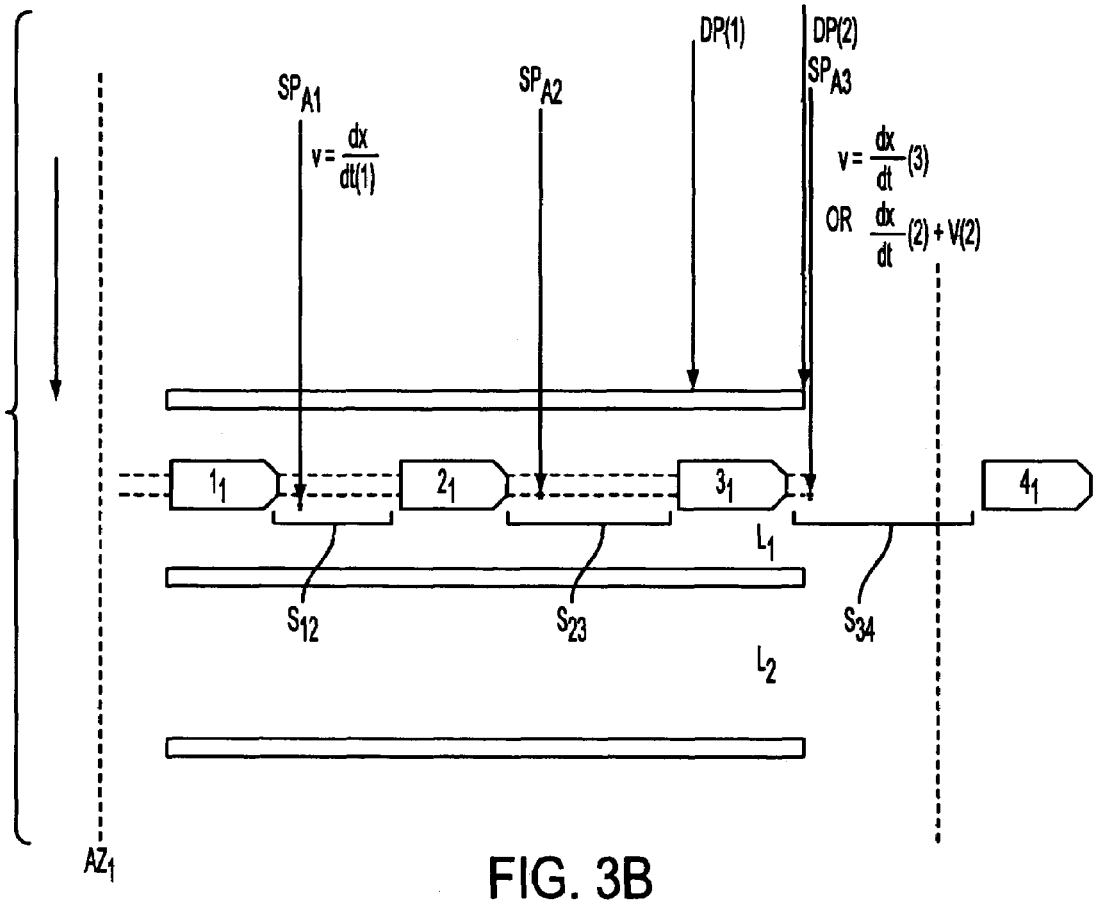
FIG. 3B is the traffic flow control system after activation.

FIG. 3B shows the conceptual implementation of the invention with the spacers implementing the flow control (or in an active state). Spacer controls S(1-2), S(2-3) and S(3-4), are activated when an activation event is detected at detection zone or detection point(s), DP1, DP2, such as the velocity of any vehicle in the congestion zone (not shown) reaches a low threshold, which is zero in a preferred embodiment. Spacer S(3-4) allows the distance to increase between vehicles V4 and V3, in lane L1, by allowing V4 to accelerate faster than V3. Similarly V3 is allowed to accelerate faster than V2 through spacer S(2-3), increasing the distance between V2 and V3. The spacers are either simultaneously or serially deactivate, when a release event is detected in the detection zone or detection points, DP1 or DP2. For example if the velocity of a vehicle at DP(1) is 10 m/s then traffic flow is no longer necessary in at least a portion of the congestion zone. Other release event criteria may be appropriate such as the distance between V4 and V3, or any two vehicles in the sequence is great enough where flow control is no longer necessary. One of the advantages of the present invention is that it need not be active when traffic is flowing acceptably.

The sensors at the detection points will determine that the traffic congestion event has ended and deactivate the spacers allowing traffic to proceed normally. It is contemplated that these sensors are generally well-known as stand-alone devices, and can be pressure strips in the roadway, optical sensors, RADAR velocity detectors, timing devices, or any combination thereof. It can be appreciated that the particular traffic sensing device is not vital to the invention other than the information detected will have to be processed by the control system and thus, interface devices should be careful considered during implementation, in addition to environmental conditions, durability and cost. For example pressure strips in the roadway may have more maintenance free durability than other devices.

As will be discussed subsequently, the calculations necessary to produce the desired spacing, velocity and acceleration control range from simple to complex calculations for the application of differential equations to traffic flow problems. A good reference regarding the calculation/computation aspect of the invention is *Traffic Flow Fundamentals*, by May (Prentice-Hall, 1989), *Mathematical Theories of Traffic Flow*, by F. A. Haight, (Academic, 1963), as far as teaching the necessary computation solutions related to traffic control implementation, these references are incorporated by reference. Particularly useful references published by the Transportation Research Board are *Highway Capacity Traffic Flow and Traffic Control Devices*, (June, 1977) and *Traffic Flow Theory and Highway Capacity* (June 1989), which are both incorporated by reference herein for all purposes. Another useful reference is *Multiclass Continuum Modelling of Multilane Traffic Flow* by Serge Hoogendoorn, (Coronet, 1999). The computational aspects of the invention are not the novel and non-obvious aspects, but are important aspects of implementing the invention in simple or complex traffic control systems.

Figure 3C:
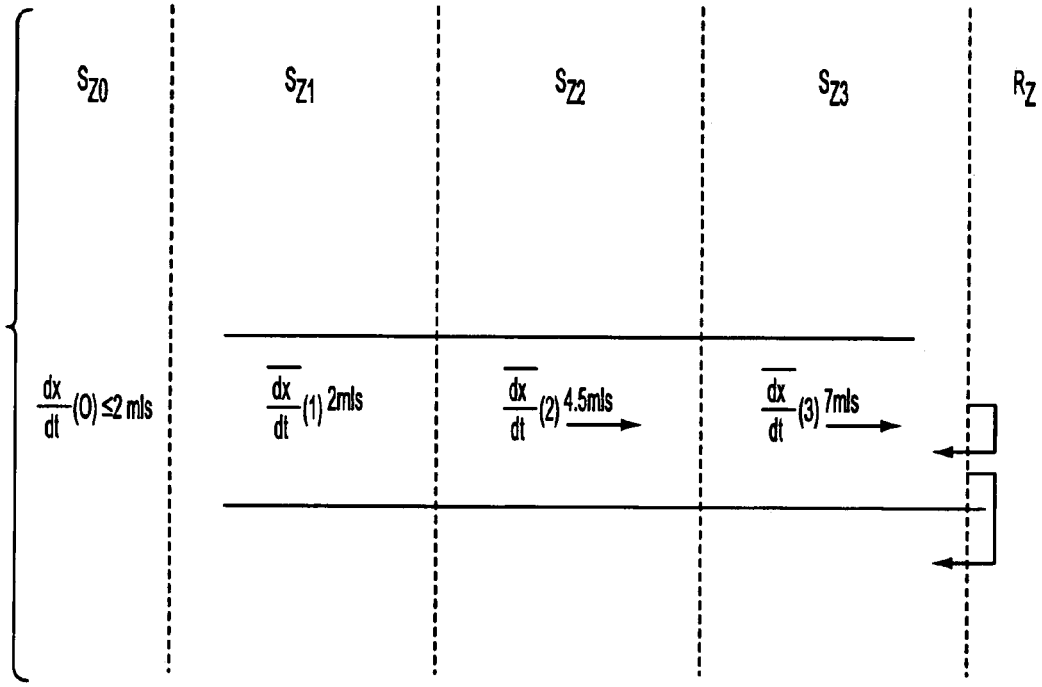
FIG. 3C shows the representation slot zones and sample corresponding velocities for spacing.

Referring now to FIG. 3C, a portion of the congestion zone (not shown) includes control zones or Slot Zones, shown as SZ0, SZ1, SZ2, SZ3 at one end of the congestion zone is a release zone (RZ), which may be any of the slot zones if it is appropriate, but is shown for illustrative purposes such that velocity, spacing and acceleration control is not present in this zone. As illustrated by FIG. 3 the average velocity in the respective slot zones allows for the spacing of vehicles, in the front of the zone. Thus, vehicles in SZ3 are allowed to travel at 7 m/s, in SZ2 4.5 m/s, SZ1 2 m/s. In SZ0 the average vehicle velocity may or may not need to be controlled depending on the conditions in the front slot zones.

FIG. 3C shows representational slot zones Sz0, Sz1, Sz2, Sz3 (and release zone Rz) each with sample average velocities that allow the vehicles to space out increasing traffic-flow speed. The structures are a single embodiment of the invention, but not the preferred embodiment as it is contemplated that building any type of infrastructure would be prohibitive difficult with existing crowded highways. Rather, the effect of the physical structures may be contemplated in other embodiments that implement components that require cooperation between systems and will be discussed below.

Figure 3D:
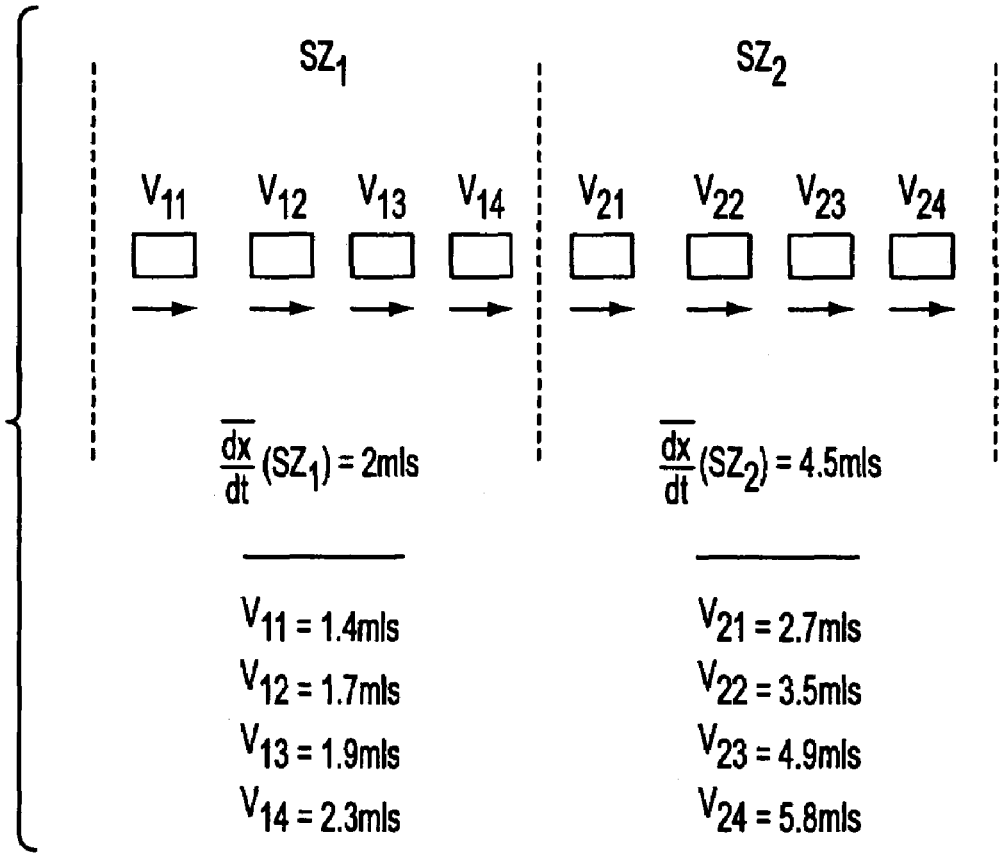
FIG. 3D is a closer view of two representative slot zones.

FIG. 3D is a close up of two individual acceleration control zones, Sz1 and Sz2, and a sample of four representative vehicles in each respective zone (V11–V24) and their speeds or velocity limitations. Each zone may include more than four vehicles, or less than four depending on the effectiveness of individual implementations of the transmission systems. More than one vehicle may be allowed to travel at a velocity as long as the general principle of the invention is being applied to dissipate the congestions.

Figure 5A:
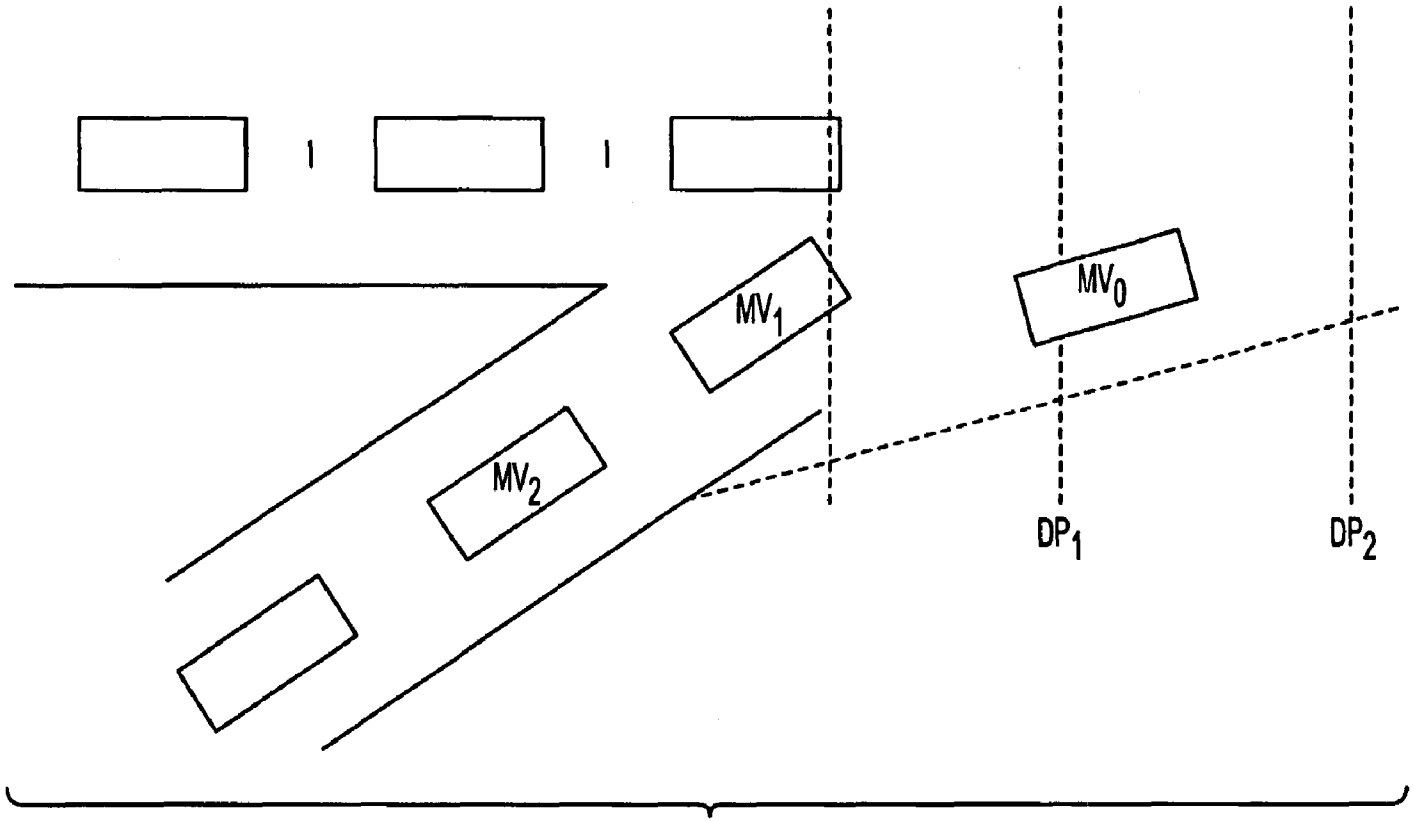
FIG. 5A is a merge control system embodiment of the invention at a first time.
Figure 5B:
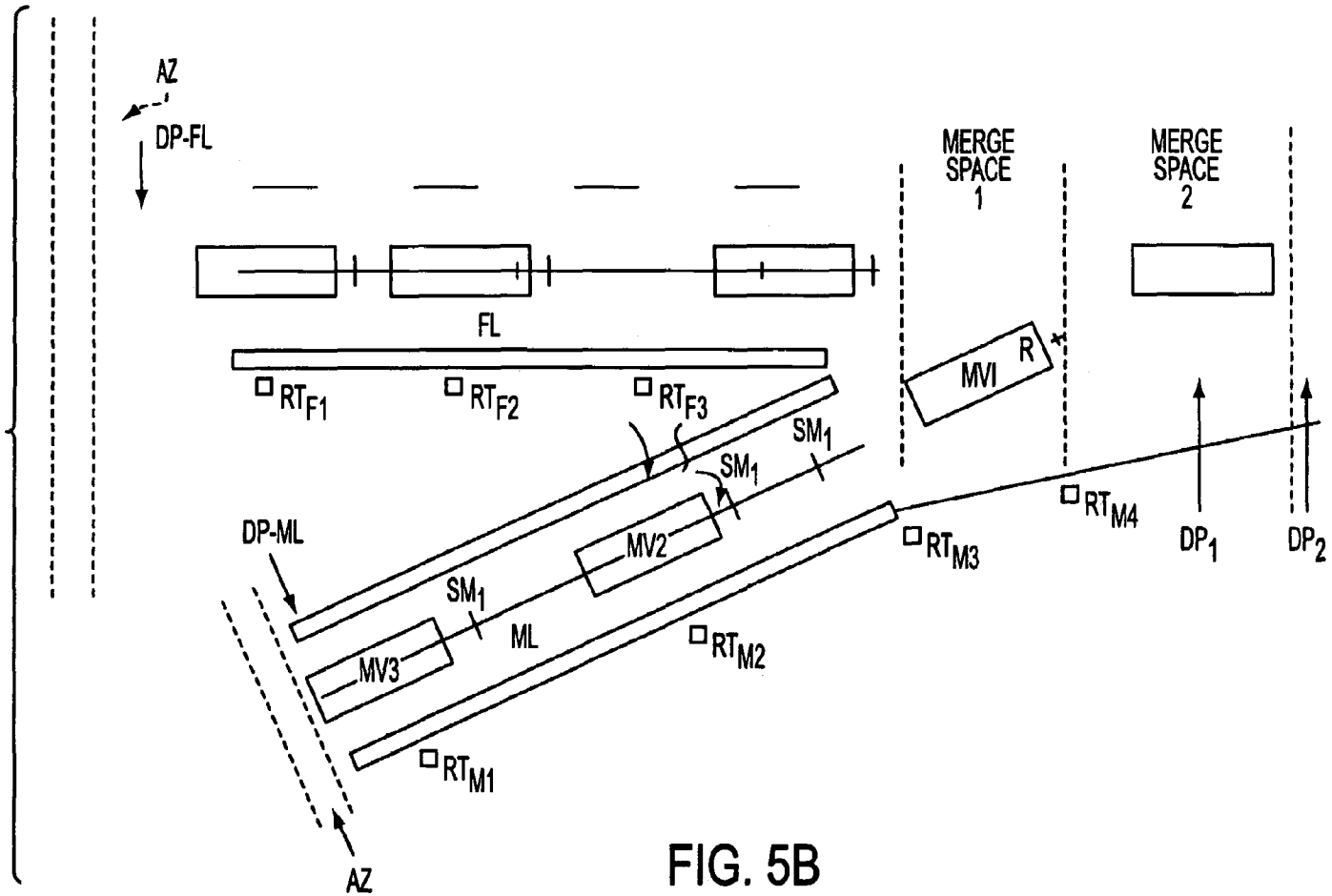
FIG. 5B shows the merge control embodiment at a second time.

As can be appreciated, the spacing control system may also be implemented in two dimensions. Not so much as an X and Y, but with regards to merges, exits, multiple lane controls, etc. The system can be used in the forward direction for single lane control flow, but also can be used for merging control such as on-ramp allowing cars to automatically enter a created space, which is shown in a first state in FIG. 5A at time t(0). The invention is shown as activated at time t(0)+j in FIG. 5B. Thus, velocity control of vehicle in both the merging lane ML (MV1, MV2, MV3) and the Flow lane FL (FV1, FV2, . . . ) may be necessary. Although velocity control in only the merging lane ML may be needed depending on the events detected in detection points DP1 and DP2. Although in the merge lane context detection points, DP-FL and at the rear of the congestion zone (not shown) and the merge lane DP-ML may be more desirable.

Figure 4A:
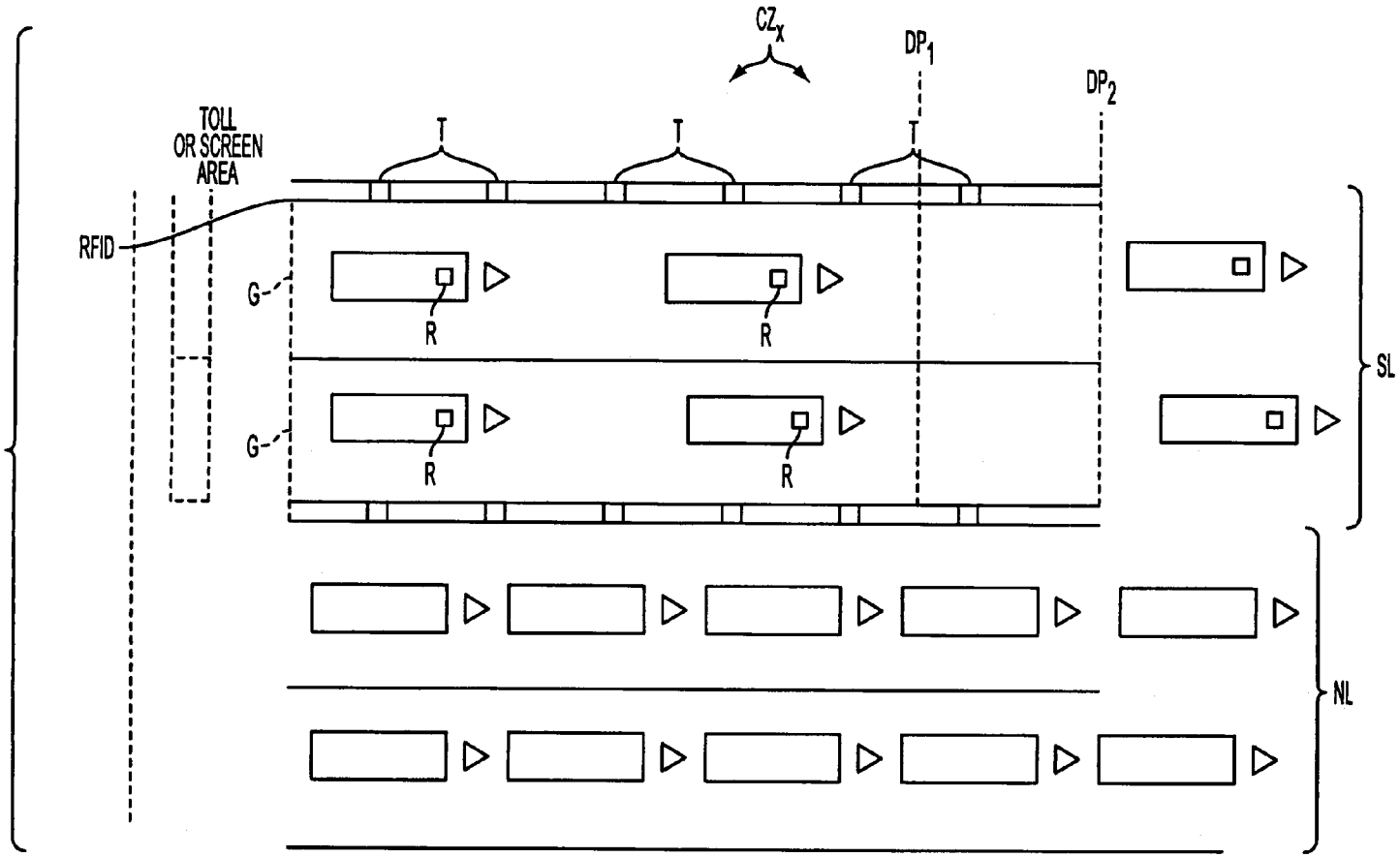
FIG. 4A is a sample of the invention as used in a comprehensive traffic congestion reduction system with control lanes and standard lanes.

Referring now to FIG. 4A, optional special lanes may only be entered through an RFID gate or tollway, in which cars have the automatic control (or not for a special tollway) allowing the top speed of the car to be governed in the case of a congestion event. Transmitters beneath or on the side of the roadway transmit the appropriate spacing speed for the slot zone preventing all congestion through proper traffic spacing. A method for implementing an access controlled traffic flow regulated system, like that shown in FIG. 4A may include access control that may implement desired regional traffic infrastructure features such as high occupancy vehicle (HOV) lane compliance. For example, in one of the implementations of the present invention, each subscriber is given an RFID transponder in the form of a keycard (not attached to the receiver). During HOV only rush hour periods, there must be two keycards in the vehicle at the TOLL SCREEN POINT in FIG. 4A to access the congestion-reduced zones of the present invention. In order that traffic not get jammed at the toll entrance, if an account holder accesses the congestion reduction zone without an additional keycard present (or a low account balance or other scenario) they may be charged additionally or taxed. Of course, a vehicle may simply be prevented from entering the zone without the special adaptation receivers, or charged additional money for such. It is contemplated that if multiple levels of access are desired a series of two or more RFID systems may be desired. Thus, the incentives to travel in the reduced congestion lanes which may be blocked off from the regular travel lanes can be adapted to help solve the needs of the regional traffic authorities.

Figure 4B:
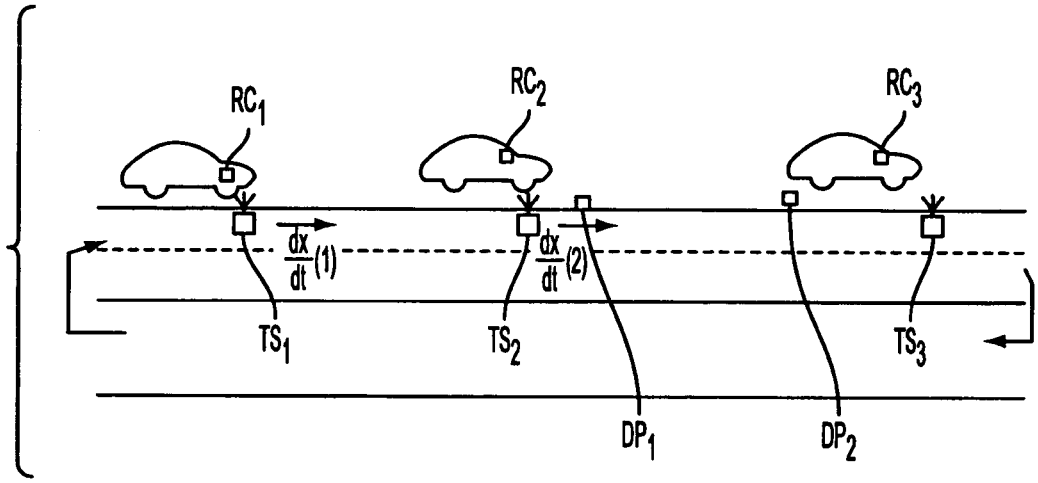
FIG. 4B is a diagram of the part of the traffic control system in a preferring RF broadcasting and receiving embodiment.

FIG. 4B is a side and blown up view of a section of FIG. 4A in a preferred representative embodiment that includes transmission devices TS1, TS2, TS3, connected to a control system (not shown) and a governor-receiver RC1, RC2 and RC3 in the vehicle that responds to each transmitter through a RF (with optional ID) system, such that the vehicle cannot accelerate beyond the appropriate slot zone speed after activation. Thus the vehicle in front is allowed to travel, for example, at 7 m/s while the vehicle in position 1 is only allowed to travel at 1 m/s until reaching slot zone 2. The optional passive RFID systems in vehicles may also be used for tracking and are commonly implemented in such commercial applications as EZ-PASS in which a RFID device reads a transponder located in a moving vehicle to record a toll fee and to send a monthly bill. The transmission and reception system will be described more in detail below. Detection Points DP1 and DP2 may be used to detect velocity, speed, distance, or used for checking data received by the transmitter systems TSx. The transmitters do not need to be able to receive information from the vehicles in one embodiment if information regarding the overall traffic dissipation conditions is obtained. Thus, a simplest first embodiment would not use the RFID, but a simplified transmission that is received by each automotive receiver RCx to regulate its acceleration. As discussed above a "zone" may be treated as a single vehicle for the purpose of traffic dissipation. Thus all the cars in a zone may be allowed to achieve 0.6 m/s which the all the vehicles in trailing zone are allow to achieve 5 m/s, thus achieving the desired effect without the need for individualized information regarding each vehicle.

Figure 6A:
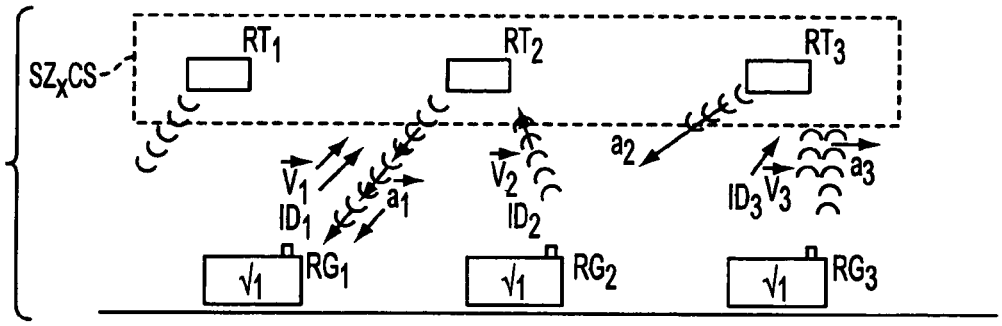
FIG. 6A is the traffic control invention that is implemented to stationary or moving transmitters in the speed control zone.

Referring now to FIG. 6A, a single transmission reception zone SZx is shown. In the control system for the slot zone SZxCS there are three transmitters RT1, RT2, RT3, and three sample vehicles V3, V2, V1 (the order has been changed to show that numbering is arbitrary and for purposes of illustrations) with three respective velocities, σ1, σ2, and σ3 ("σ" is used for velocity instead of v). FIG. 6A also shows an optional initial transmission states as it applies to vehicles V1, V2 and V3 with respective receiver controller/governors RG1, RG2, and R3, respectively is shown. An optional ID is detected by the transmitter(s) RT2 and RT3 in a fashion similar to the EZ-PASS RFID systems used in toll lanes on many highways and based on a transponder located in a vehicle and in particular in the RGx device or adjacent thereto. Similarly, an optional broadcast of the vehicles current velocity σ1 takes place along similar lines, although the broadcast is not passive like an ID would be. In a second transmission state an acceleration or velocity limit(s) a1, a2, and a3 are broadcast to the RG devices in order that the vehicles will not accelerate too quickly and create unnecessary congestion.

Figure 6B:
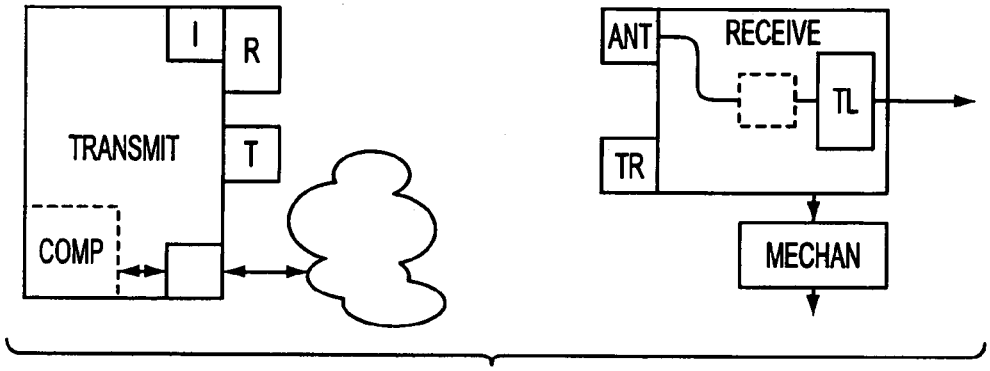
FIG. 6B is a transmission and receiver device represented by functional blocks in a first embodiment.

Referring now to FIG. 6B, the representative transmitter system T and receiver system R shown in FIG. 6A are shown. The transmitter system TRANSMIT may be an RFID broadcast device or other EMF transmission device using an appropriate frequency (approved by the FCC or on a free channel). The transmitter may also use optical signals. The transmitter system includes a transmitter Tr and a computational device COMP, which may be physically located in the transmitter system or virtually connected through transmission, LAN, or specialized network to other transmitter system devices through an optional network interface NI. The transmitter system may include and optional receiver Rc and input interface I that allow information from the transponders to be received and processed. The network may allow each transmission system T to be activated upon the detection of a traffic congestion event or simply include computation information to be transmitted to the Also shown in FIG. 6B is receiver system R, which include a device that allow acceleration or velocity control signals from the transmitter system T to be processed. An optional antenna or signal reception device takes EMF or other appropriate signals and processes them through an interface for translation in the translator TL, so that the signals may be used to control the acceleration of the vehicle. The processor PROC may be an ASIC designed specifically to quickly decode transmissions from the reception structures to a physical embodiment. As can be appreciated there are velocity/speed/acceleration control mechanisms used in vehicles for safety purposes, and in particular to slow SUVs when the SUV is detected by sensors to be in a rollover situation. As such, the driver of such vehicles is not in control of the velocity as it is being slowed to a safer speed.

Figure 7:
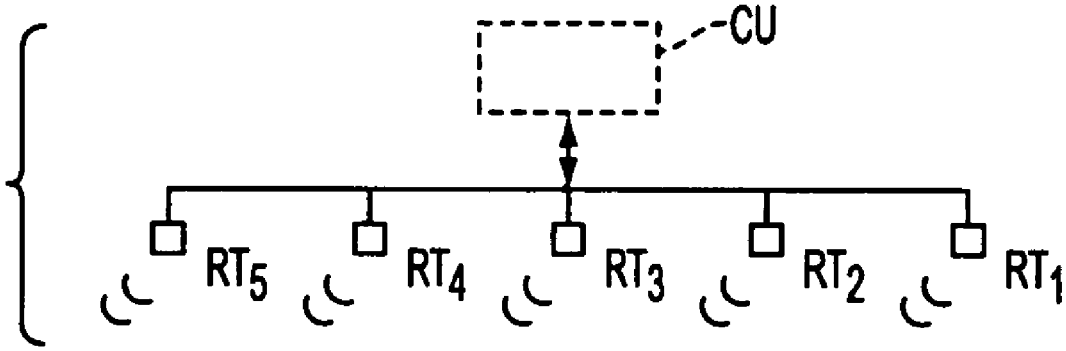
FIG. 7 illustrates the networked velocity control computation system.

Referring now to FIG. 7 a networked series of transmission systems RT1 . . . RT5 connected to each other via a LAN, WAN, or wireless network to a physical or virtual computation device CU. The computation device considers the information form the various transmitters RT1, . . . , RT5 in the optional embodiment or simply calculates targeted velocity or acceleration control to be transmitted to vehicles in particular zones. The computation device CU may record data or actually control the transmissions and may be located anywhere in the networked system. The control computations will depend on many parameters, lanes, regional traffic conditions, driver behavior, recorded traffic events. Some of these are discussed in the incorporated references. A simplified example of a representative single lane traffic flow computation table is shown below. These tables are meant to be representative only of the information as can be appreciated by those skilled in the art. In the table below the vehicles shift one "slot" for 2 seconds traveled. The speed at the front of the congestion zone increases more quickly than that at the back of the zone.

TABLE 1

Representative Flow rates across RT coverage.

| Transmit (t = 0) | Vehicle | Transmit (t = 2 s) | Vehicle |
|---|---|---|---|
| RT5 | V5-1: 7 m/s | RT5 | V5-1: Exit |
| | V5-2: 6.5 m/s | | V5-2: 7 m/s |
| | V5-3: 6.1 m/s | | V5-3: 6.5 m/s |
| | V5-4: 5.7 m/s | | V5-4: 6.1 m/s |

TABLE 1-continued

Representative Flow rates across RT coverage.

| Transmit (t = 0) | Vehicle | Transmit (t = 2 s) | Vehicle |
|---|---|---|---|
| RT4 | V4-1: 5.2 m/s | | V4-1: 5.7 m/s |
| | V4-2: 4.8 m/s | RT4 | V4-2: 5.2 m/s |
| | V4-3: 4.4 m/s | | V4-3: 4.8 m/s |
| | V4-4 4.1 m/s | | V4-4 4.4 m/s |
| RT3 | V3-1 3.7 m/s | | V3-1 4.1 m/a |
| | V3-2 3.4 m/s | RT3 | V3-2 3.7 m/s |
| | V3-3 3.2 m/s | | V3-3 3.4 m/s |
| | V3-4 3.0 m/s | | V3-4 3.2 m/s |
| RT2 | V2-1 2.8 m/s | | V2-1 3.0 m/s |
| | V2-2 2.6 m/s | RT2 | V2-2 2.8 m/s |
| | V2-3 2.4 m/s | | V2-3 2.6 m/s |
| | V2-4 2.2 m/s | | V2-4 2.4 m/s |
| RT1 | V1-1 2.0 m/s | | V1-1 2.2 m/s |
| | V1-2 1.8 m/s | RT1 | V1-2 2.0 m/s |
| | V1-3 1.6 m/s | | V1-3 1.9 m/s |
| | V1-4 1.4 m/s | | V1-4 1.8 m/s |
| | No Vehicle | | V0-Enter 1.7 m/s |

Figure 8:
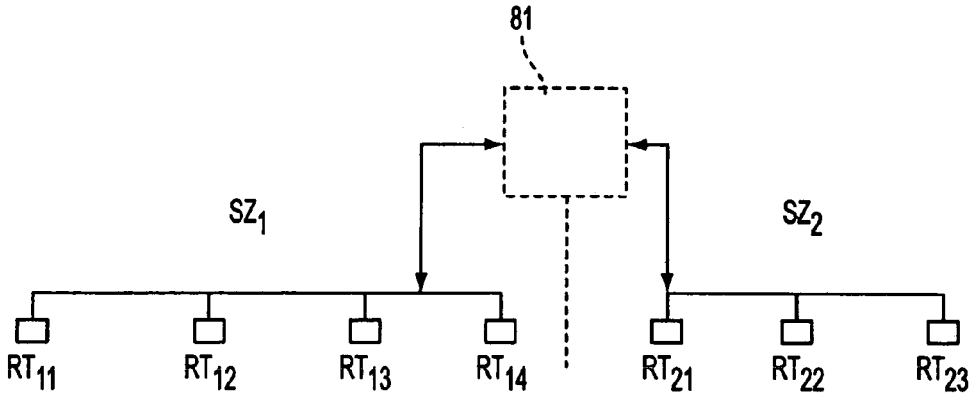
FIG. 8 illustrates a multiple zone network computation system and flow of data.

Referring now to FIG. 8 an interzone networked system is shown. The transmitters in two zones Sz1 and Sz2 are connected via WAN, LAN or dedicated connection to interzone computation unit 81. The interzone computation unit adjusts the acceleration broadcasts dependent upon the information received from the detection points or received from the transmitters, if they are so equipped. The delta in acceleration for the SZ1 is only one example of how this embodiment may be applied. This scenario is based on a faster than anticipated dissipation in SZ2.

TABLE 2 interzone computation

| Transmit | Avg. Vel. | Delta Acc. |
|---|---|---|
| RT23 | 8 m/s | n/a |
| RT22 | 7.4 m/s | n/a |
| RT21 | 6.7 m/s | n/a |
| RT14 | 5.0 m/s | +.5/s2 |
| RT13 | 4.4 m/s | +.5/s2 |
| RT12 | 4.0 m/s | +.5/s2 |
| RT11 | 3.5 m/s | +.5s2 |

As can be appreciated the flow of information need not flow from front to back, but can flow from back to front as well.

Figure 9:
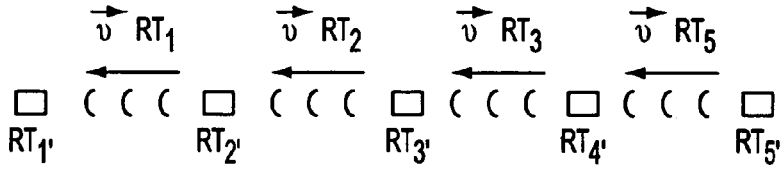
FIG. 9 illustrates a wireless linear flow of information in the transmission system in a first direction.
Figure 13:
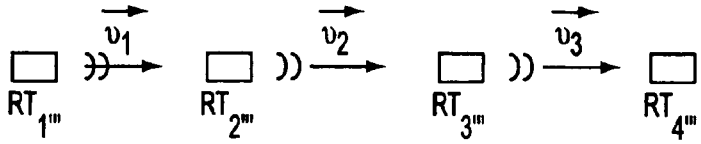
FIG. 13 illustrates a wireless linear flow of information in the transmission system in a second direction.

Referring now to FIG. 9 another alternate embodiment of the invention in a wireless front to back linear inter-transmitter data flow is shown. In a similar embodiment shown in FIG. 13 is a wireless back-to-front linear data flow. In either of the embodiments shown in FIG. 9 or FIG. 13 may be combined if it is shown to be advantageous. The data flow is designed to adjust the transmission of the velocity limitations as it becomes necessary. In the linear data flow embodiments, each transmitter may be adjusted solely based on the data received from the neighbor simplifying the invention. Thus, in FIG. 9, RT1 needs only data from RT2 to adjust the transmitted speed optimally, and does not need to receive information from RT4

Figure 10:
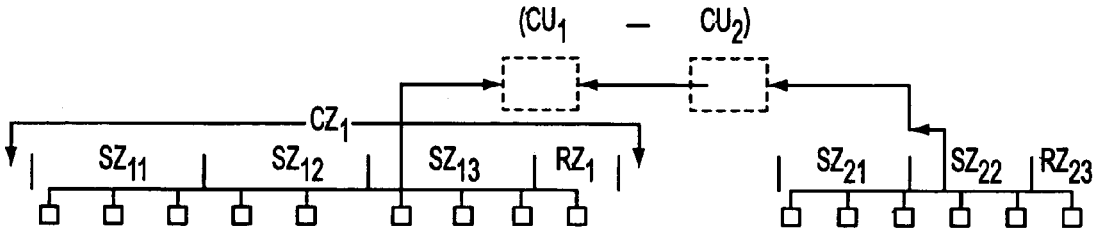
FIG. 10 illustrates a multiple congestion zone network.
Figure 12:
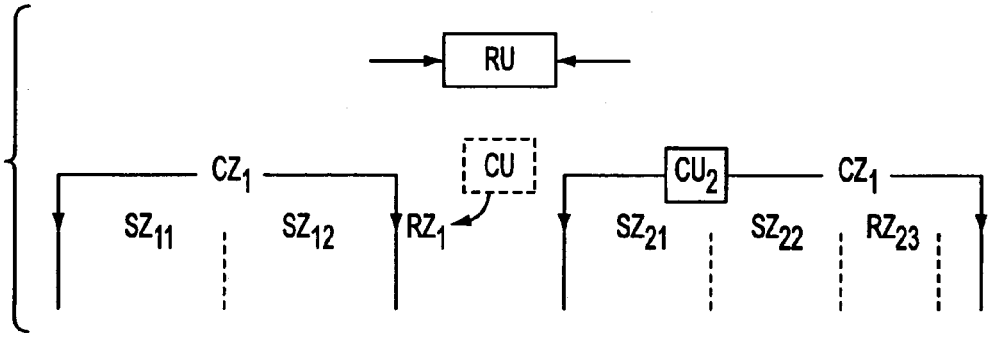
FIG. 12 illustrates a global intelligence system for traffic control.

FIG. 10 shows an embodiment which may be particularly advantageous for implementing the invention on a large scale in which computation units for each congestion zone CZ1 and CZ2, CU1 and CU2, respectively are connected to each other to share data to adjust transmitted speed which is controlled locally by CU1 and CU2. FIG. 12 shows a regional traffic computation system RU receiving information from CU1 and CU2, but unlike the embodiment in FIG. 10 RU may make overriding decisions regarding inter congestion zone CZ1 and CZ2 velocity control.

Figure 11:
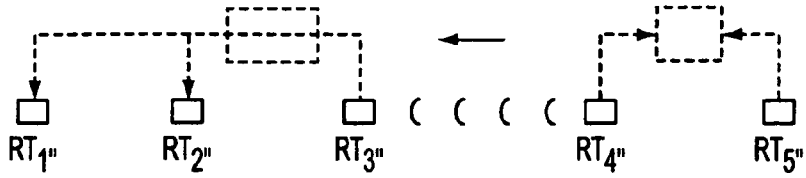
FIG. 11 illustrates a discrete computation network and flow of data.

FIG. 11 shows another alternate embodiment in which the modular aspects of a group of transmitters may be collected and applied to another group. For example, the data from RT4''' and RT5''' is collected and applied to RT1''' . . . RT3''' to adjust the transmitted acceleration limits. This embodiment may be particularly useful in applications which the conditions are marked from one part of the congestion reduction zone to the next. For example in a merge shown in FIG. 16, the conditions at which the merge lane has collapsed into the two remaining lanes (RT4''' . . . RT5''') may require a particular application, while the zones that include the merge lane (e.g. RT1''' . . . RT3''') require another application.

Figure 14:
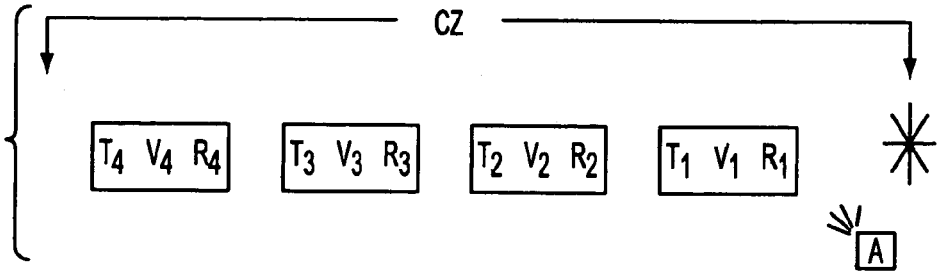
FIG. 14 is an alternate embodiment of the present invention wherein receivers and transmitters are located on vehicles in the congestion reduction zone.

Referring now to FIG. 14 another alternate embodiment of the invention is shown where the transmitter and receiver systems are located on vehicles in the congestion reduction zone. In this alternate embodiment, the inter-vehicle traffic control system, the transmitters T1 . . . T4 are activated when Activation module A transmits an EMF signal when an event at one or more detection points DP1 is detected. Such events may be the same or similar to those detailed above and include a low threshold velocity of one or more vehicles or other adverse traffic event.

The transmitters T1 . . . T4 are located on vehicles V1 . . . V4, respectively, along with receiver systems R1 . . . R4. The receiver systems R1 . . . R4 include a non-negative acceleration control module and possibly an optional de-celeration or negative acceleration module. The inter-vehicle embodiment of the invention has particular advantages and drawbacks when compared to the preferred embodiment.

Advantages of the inter-vehicle system include the fact that activation modules A may be placed a various locations as they are necessary to traffic control, and are therefore more "portable" than the preferred embodiments. Much longer stretches of roadway may be covered by the control system for less infrastructure cost. However, increasing the complexity of the electronics needed in the vehicle, transmitter, distance computation device, and receiving and acceleration control system would appear to decrease many of the economical advantages of the preferred embodiments which require only passive reception devices in vehicles coupled with acceleration or velocity controllers.

Another alternate implementation of the inter-vehicle system is where there are no external activation modules. However, the increasingly complex circuitry and transmission devices needed inside the automobile may prohibit many drivers from subscribing to such a system. However, the cost of serious traffic congestion results in lost revenue for governments and businesses as well as lost wages to individuals. As traffic infrastructure becomes increasingly volatile the cost of alternate embodiments may become an economically viable options even if devices for transmission and non-negative acceleration control must be provided to drivers.

Figure 15:
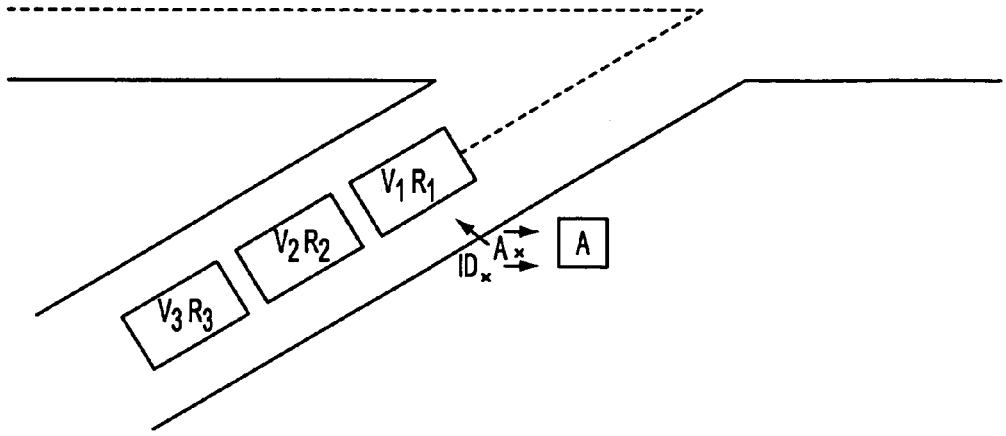
FIG. 15 is an alternate embodiment of the invention in a traffic control for a highway merge.

Referring now to FIG. 15, a simplified alternate embodiment for merge congestion is shown. Instead of an ineffective traffic light for an on-ramp that may or may not be effective at regulating merges during heavy traffic periods or even take into account that spacing in the travel lane TL may be such that regulating the merge lane ML is not needed. The simplified merge system has an activation or transmission device A at a targeted location at the end of the on-ramp. The activation device A may be connected to a timing or spacing detector TM which may be connected to detection devices at detection points DP1 or DP2, or simply include any required electronics for detecting appropriate criteria for merging. The activation module A may simply prevent vehicles from entering the merge into the travel lane TL by reducing or eliminating their ability to accelerate.

Figure 16:
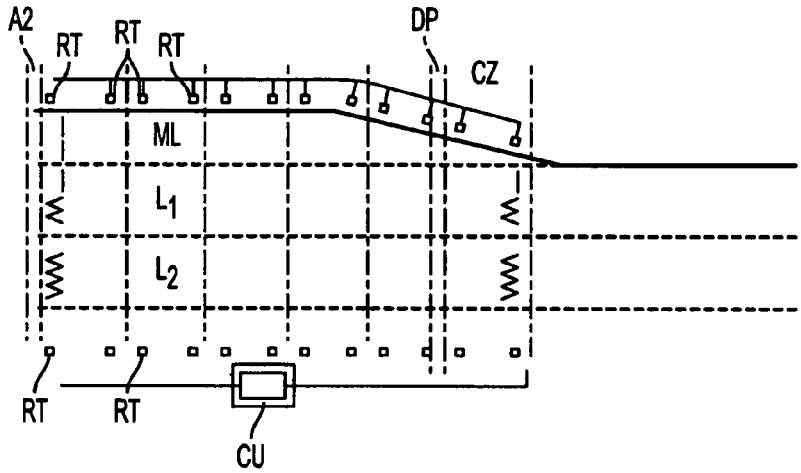
FIG. 16 is a second alternate embodiment for multiple lane traffic flow control in a highway merge.

Referring now to FIG. 16 a multiple lane embodiment of the invention is shown for a highway merge. The transmitters are shown at points through the congestion control zone on multiple sides of the highway. The flow of information from transmitter to transmitter (or simultaneously) will depend on the roadway conditions. However, in the illustrative merge, the critical zones or important zones are most likely where the merge finally ends and drivers fail to space in the travel lane, creating gridlock. Thus, information on those zones would flow from the front of the congestion control zone to the back, either simultaneously, or in a staggered fashion, such that the vehicles multiple lanes can be spaces as to inhibit congestion.

Figure 17:
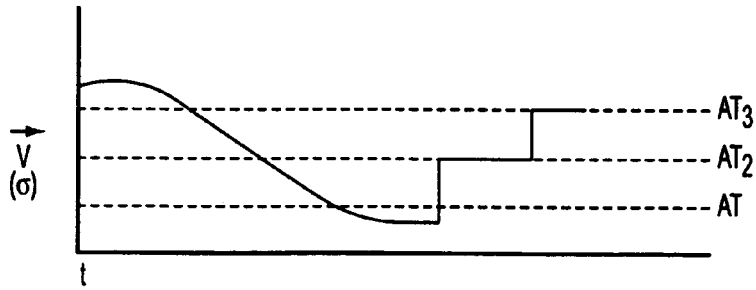
FIG. 17 is a sample diagram of unidirectional non-negative acceleration control in the present invention as implemented by a governor system.

Referring now to FIG. 17 an exclusively non-negative acceleration system is shown. The non-negative acceleration is part of a preferred embodiment of the invention and unlike the negative acceleration systems current used to prevent SUV rollover or other "slow down" mechanisms. Although it is contemplated that the present invention could use known deceleration devices in controlling the velocity of the vehicles, the reliability and safety of the velocity control system is though to be a more popular and economic implementation if vehicles are not "slowed" by external events. It is contemplated that limiting the positive acceleration when a vehicle has dropped below a low threshold speed would be a much more viable and safer option for drivers. Additionally, the redundancy required from an positive, or rather non-negative acceleration governor would be greatly reduced that for a device that could decelerate the vehicle as well.

FIG. 17 shows that a non-negative acceleration governor may be placed on standby but cannot be activated until the vehicle drops below a low threshold speed or event shown at as an activation threshold or AT. In a preferred embodiment the low threshold is zero, but it may be other speeds according to the conditions that are appropriate for the congested roadway. FIG. 17 also shows that two different transmissions to the non-negative acceleration governor system AT2 and AT3, respective resulting in three different discrete velocity levels (where the curve flattens out) for the vehicle at three points in time as the control transmitters relay the appropriate signals to dissipate the traffic congestion.

Figure 18:
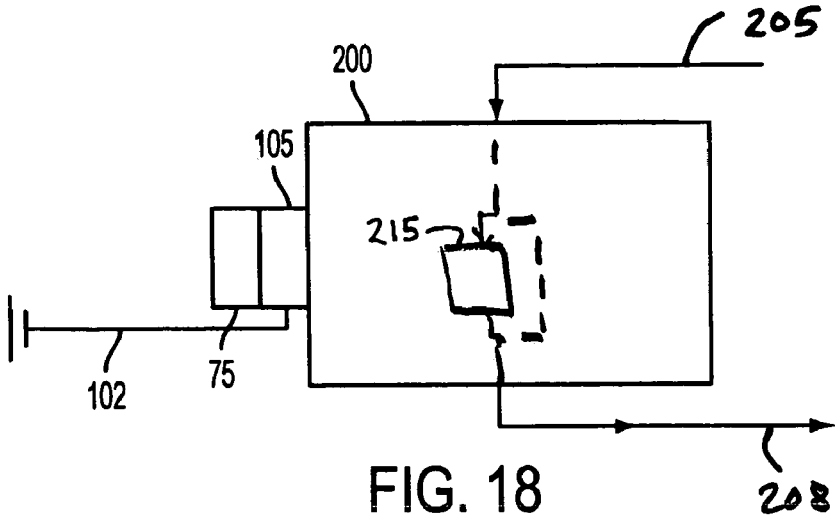
FIG. 18 is an illustrative diagram of an embodiment of the non-negative acceleration control system.

Referring now to FIG. 18 a detailed version of the acceleration control system is shown in more detail. A sample illustration of the system includes the receiver module 75, an activation module 105, an acceleration controller 200 connected to the automotive systems that accelerate the automobile incoming 205 and outgoing 208 signal lines. A power source 102 is coupled to the activation module 105. A virtual bypass 215 is an optional feature of the invention.

Figure 19:
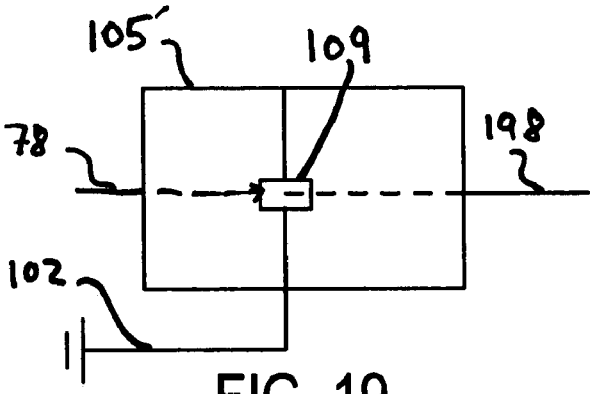
FIG. 19 is a detail of the non-negative acceleration system power control.

The receiver 75 detects the appropriate external EMF signal and allows that activation module 105 to turn on the acceleration controller 200. The input signal line 205 and output signal line 208 may be routed through the accelerator control 200 in a manner that mandates that the acceleration control 200 controls the output signal 208 if it is activated. The virtual bypass module 215 simply means the acceleration signals in the vehicle are always routed through the acceleration controller 200 although most of the time it is not active. As such, signal line 205 and 208 will be functionally directly connected if the acceleration controller 200 is not activated, Referring now to FIG. 19, a sample detail of the power system in a typical activation module 105' is shown. The sample activation module 105 includes a switch 109 that includes a receiver input 78 and the power source 102. The power switch 109 gives power to the acceleration controller 200 through the power output 198. The power system shown in FIG. 19 serves to limit power to the acceleration controller 200 unless a signal from the receiver 75 is present in the activation module 105. This prevents the acceleration controller from activating when the receiver 75 is not detecting the appropriate signal.

Figure 20:
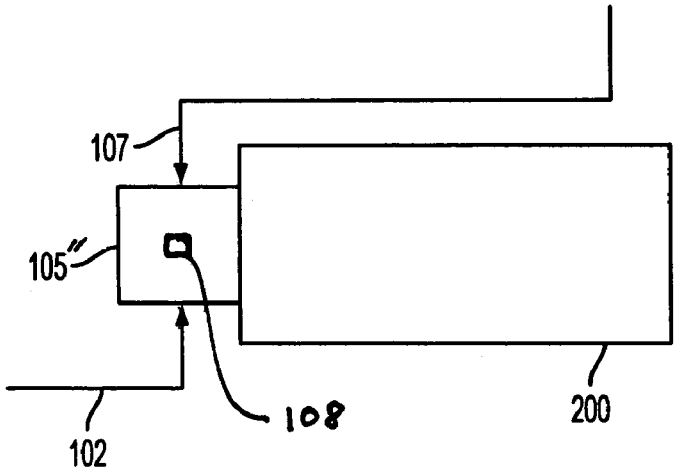
FIG. 20 is an illustration of the activation module using a velocity input.

Referring now to FIG. 20, a detail of the functional aspects of the activation module 105" that includes a threshold velocity input 107. The activation module will accept a signal along the velocity input 107 and an activation switch 108. The velocity input 107 creates a situation illustrated in FIG. 17 in which the acceleration controller 200 will not get power to activate unless the velocity of the vehicle drops below an target threshold, in a preferred embodiment is zero, but can be any other number of target thresholds. The activation switch 108 can also include the receiver input 78 to control the power to the acceleration control 200, through power output 198. As described above in FIG. 17, there can be multiple signals output that determine multiple velocity thresholds or acceleration limits, either in discrete steps (as shown in FIG. 17) or a continuous upward curve. The velocity input 107 also serves to ensure that a negative acceleration never occurs through the mis-activation of the acceleration controller 200.

The invention herein is described in several embodiments that are not meant to be exhaustive but rather illustrative only. As can be appreciated by traffic and transportation specialists, there are other way to implement the invention which do not depart from the scope of the invention and thus, the invention should be considered as defined by the claims below.

Having thus described my invention, I claim:

1. A non-negative acceleration control system for use in vehicles comprising an external transmitter, and an internal non negative acceleration control wherein said external transmitted emits a positive acceleration limitation signals when the speed of a vehicle reaches zero, wherein said internal non-negative acceleration control receives said positive acceleration limitation signals and is operatively coupled with acceleration system in a vehicle, wherein said non-negative acceleration control system is not capable of causing negative acceleration in said vehicle, and wherein said vehicle cannot accelerate beyond a threshold velocity, when a positive acceleration limitation signal is transmitted.

2. The non-negative acceleration control system as recited in claim 1, wherein said control system is activated by receiving a signal from a transmitter located externally to said vehicle.

3. The control system as recited in claim 1, wherein said internal acceleration control is continuously activated until said vehicle exits a traffic congestion control zone or a traffic event has subsided.

4. The control system as recited in claim 3, wherein said traffic event is an average spacing between vehicles.

5. The control system as recited in claim 3, wherein said traffic event is a low threshold velocity of a number of vehicles.

6. The control system as recited in claim 3, wherein said traffic event is a low threshold velocity of a number of vehicles in combination with an average spacing between vehicles.

7. The control system as recited in claim 3, wherein said traffic event is an externally detected event.

8. A method for dissipating vehicular gridlock along a stretch of roadway comprising:

detecting a traffic event that requires non-negative acceleration control in a number of vehicles that are located in a control zone;

sending a signal to at least one vehicle of said number of vehicles, said at least one vehicle having reached a threshold velocity of zero and said vehicle equipped with a non-negative acceleration governor;

said configured to limit the velocity of said at least one vehicle to less than that of another vehicle in front of said at least one vehicle, wherein said signal cannot reduce the velocity of said at least one vehicle.

* * * * *